United States Patent [19]

Hawkins

[11] Patent Number: 4,565,262

[45] Date of Patent: Jan. 21, 1986

[54] LADDER APPARATUS

[75] Inventor: Donald E. Hawkins, Concord, Calif.

[73] Assignee: Stanley E. Hawkins, Exeter, Calif. ; a part interest

[21] Appl. No.: 626,319

[22] Filed: Jun. 29, 1984

[51] Int. Cl.[4] ..... E06C 1/22; E06C 7/16

[52] U.S. Cl. ..... 182/116; 182/172; 182/200

[58] Field of Search ..... 182/172, 170, 200, 121, 182/107, 108, 116

[56] References Cited

U.S. PATENT DOCUMENTS

| | | | |
|---|---|---|---|
| 540,643 | 6/1895 | Davol . | |
| 2,046,516 | 7/1936 | Johnson . | |
| 2,104,987 | 1/1938 | Harding | 182/121 |
| 2,186,119 | 1/1940 | Moen | 182/166 |
| 2,205,935 | 6/1940 | Stenroos | 182/200 |
| 2,639,853 | 5/1953 | Pierce | 182/200 |
| 2,650,014 | 8/1953 | Harrison . | |
| 2,997,127 | 8/1961 | Wojtowicz | 182/172 |
| 3,043,397 | 7/1962 | Tillotson | 182/170 |
| 3,165,369 | 1/1965 | Machen . | |
| 3,269,486 | 8/1966 | Machen . | |
| 3,474,883 | 10/1969 | Weis . | |
| 3,933,221 | 1/1976 | Sorenson . | |
| 4,175,641 | 11/1979 | Reyes | 182/172 |
| 4,249,637 | 2/1981 | Glasgow | 182/170 |

FOREIGN PATENT DOCUMENTS

| | | | |
|---|---|---|---|
| 119084 | 9/1930 | Austria | 182/170 |
| 648111 | 12/1950 | United Kingdom | 182/170 |
| 1179970 | 2/1970 | United Kingdom | 182/121 |

*Primary Examiner*—Reinaldo P. Machado
*Attorney, Agent, or Firm*—Worrel & Worrel

[57] ABSTRACT

A ladder apparatus having an elongated ladder assembly, a pair of pivotally mounted supporting legs, braces positionable to interconnect the legs and the ladder assembly to retain the legs in stable supporting relation to the ladder assembly, a collapsible platform borne by the ladder assembly and an adjustable leveling device mounted on the ladder assembly for ground engagement to support the ladder assembly on uneven surfaces. An auxiliary support assembly adapted for attachment to a ladder assembly having the foregoing elements.

10 Claims, 13 Drawing Figures

LADDER APPARATUS

BACKGROUND OF THE INVENTION

1. Field Of The Invention

The present invention relates to a ladder apparatus and more particularly to such an apparatus which is adjustable in such a manner as to permit it to be deployed securely in support of the ladder portion thereof in upstanding position in a wide variety of operative environments, which incorporates a work platform and which can conveniently and expeditiously be collapsed for transport and storage.

2. Description Of The Prior Art

The use of elongated ladders of fixed or adjustable length to reach elevated work areas has long been known. While such ladders have proved satisfactory for use in a variety of work environments, there are a host of other environments in which they cannot be used, or can only be used with the exercise of great care. A number of factors, such as the location and makeup of the work area and functional limitations inherent in the structure of the ladder itself, contribute to such limited utility.

One well recognized deficiency in most conventional ladders is that, due in large part to the narrow transverse dimensions of their bases, the ladders are susceptible to lateral slippage when in use. Such slippage can occur, for instance, due to an unbalanced lateral distribution of the weight of the user on the ladder or of equipment or supplies supported on the ladder. This problem is exacerbated in instances in which the upper ends of the ladders are rested against substantially smooth surfaces which provide minimal frictional resistance to sliding of the upper portions of the ladders laterally therealong.

A similar limitation in conventional ladders is the susceptibility to slippage of the base portions thereof away from the work area, particularly on hard, smooth surfaces such as concrete walks, driveways, foundations and the like. Under such conditions, the ladders may slide completely out from under the user.

Yet another problem encountered in the use of conventional ladders is that the work areas in which they must be deployed are frequently not suitable in that, for example, there are no substantially flat surfaces upon which to rest the base portions of the ladders or walls against which to rest the upper portions of the ladders. Positioning of the ladders on irregular or uneven surfaces not only increases the hazard for the ladders to slip in the manners heretofore described, but also to twist substantially about their longitudinal axis when mounted by the users thereof.

In still other instances, there are no vertical surfaces against which the upper portions of the ladders can be rested. There may be no vertical surfaces available for use, or those surfaces which are present may be unsatisfactory because they are in need of repair or they may be constructed of fragile materials such as glass or light-gauge aluminum which might be damaged.

A number of attempts have been made in the prior art to overcome these and other deficiencies. Such attempts by the prior art generally fall into two broad categories: ladder assemblies comprising ladder portions of substantially conventional design having stabilizing structures unitary therewith; and auxiliary stabilizing apparatuses adapted for attachment on ladders of conventional design. While such prior art efforts are adequate within the scope of their design to eliminate or minimize one or more of the limitations attendant upon the use of conventional extension ladders, each is deficient in one or more respects. For example, in such prior art ladder assemblies and attachments which employ legs for support, there is an inherent difficulty in controlling the positions of the legs. Prior art devices which use chains and the like in an attempt to limit movement of the legs are inefficient, cumbersome and easily entangled.

Yet another problem encountered in the use of conventional ladders is that none of the prior art ladders of which applicant is aware provide a surface deployable for the support of heavy equipment or the user thereof. While some stepladders have small collapsible shelves, they are incapable of supporting substantial weight or having a surface area sufficient for the deposit of more than a few small items thereon.

Therefore, it has long been known that it would be desirable to have a ladder apparatus which has the ability to be used in a wide variety of operative environments and under the most adverse conditions while securely and dependably supporting a person thereon; which has a support platform which can be deployed to support a person or relatively heavy equipment; and which can rapidly and conveniently be collapsed for transport and storage.

SUMMARY OF THE INVENTION

It is therefore an object of the present invention to provide an improved ladder apparatus which can be employed securely and dependably in a wide variety of work environments.

Another object is to provide such a ladder apparatus which can be deployed in a stable erect attitude on uneven and irregular surfaces and in adverse operating conditions.

Another object is to provide such a ladder assembly which is resistant to lateral slippage and twisting about the longitudinal axis thereof when operationally deployed.

Another object is to provide such a ladder apparatus which has legs which can be deployed in support of the ladder portion thereof and which has adjustable means rigidly to secure the legs and ladder portion in a selected relationship to each other appropriate to the particular work environment so as securely to retain the ladder portion in the desired operating position without being limited by the ambient surfaces available at the site.

Another object is to provide such a ladder apparatus which has a base portion which is adjustable to accommodate sloped or uneven surfaces.

Another object is to provide such a ladder apparatus which is of lightweight construction and can rapidly and conveniently be collapsed to facilitate the deployment and storage thereof.

Another object is to provide such a ladder apparatus which provides a collapsible platform adapted selectively to be deployed to support the user or equipment useful by the user.

Further objects and advantages are to provide improved elements and arrangements thereof in an apparatus for the purposes described which is dependable, economical, durable and fully effective in accomplishing its intended purposes.

BRIEF DESCRIPTION OF THE DRAWINGS

FIG. 10 is a somewhat further enlarged, fragmentary perspective view taken from a position generally indicated by line 10—10 in FIG. 1.

DESCRIPTION OF THE PREFERRED EMBODIMENTS

First Embodiment

Figure 1:
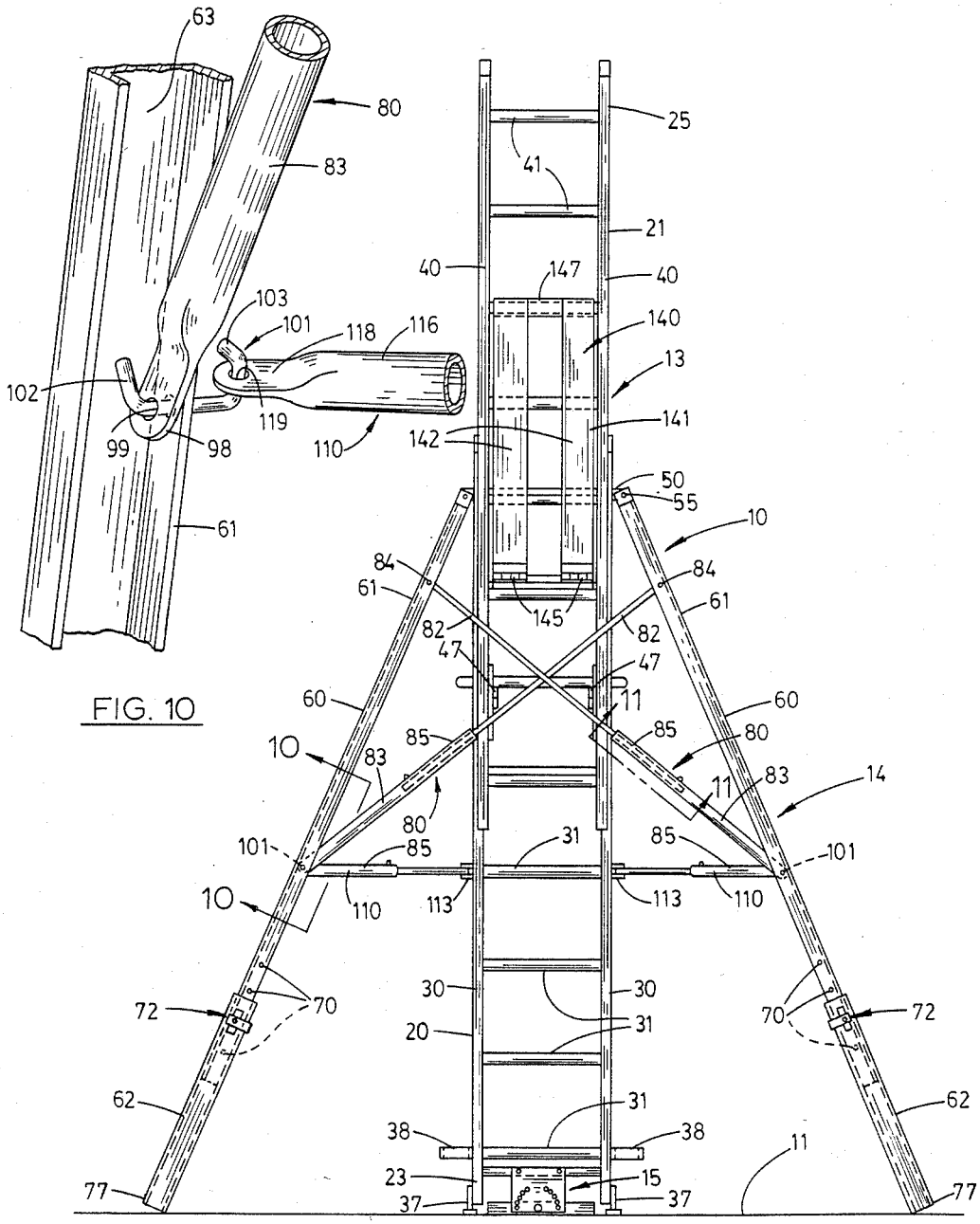
FIG. 1 is a front elevation of the ladder apparatus of the present invention deployed in a first representative operative attitude on a flat supporting surface.
Figure 2:
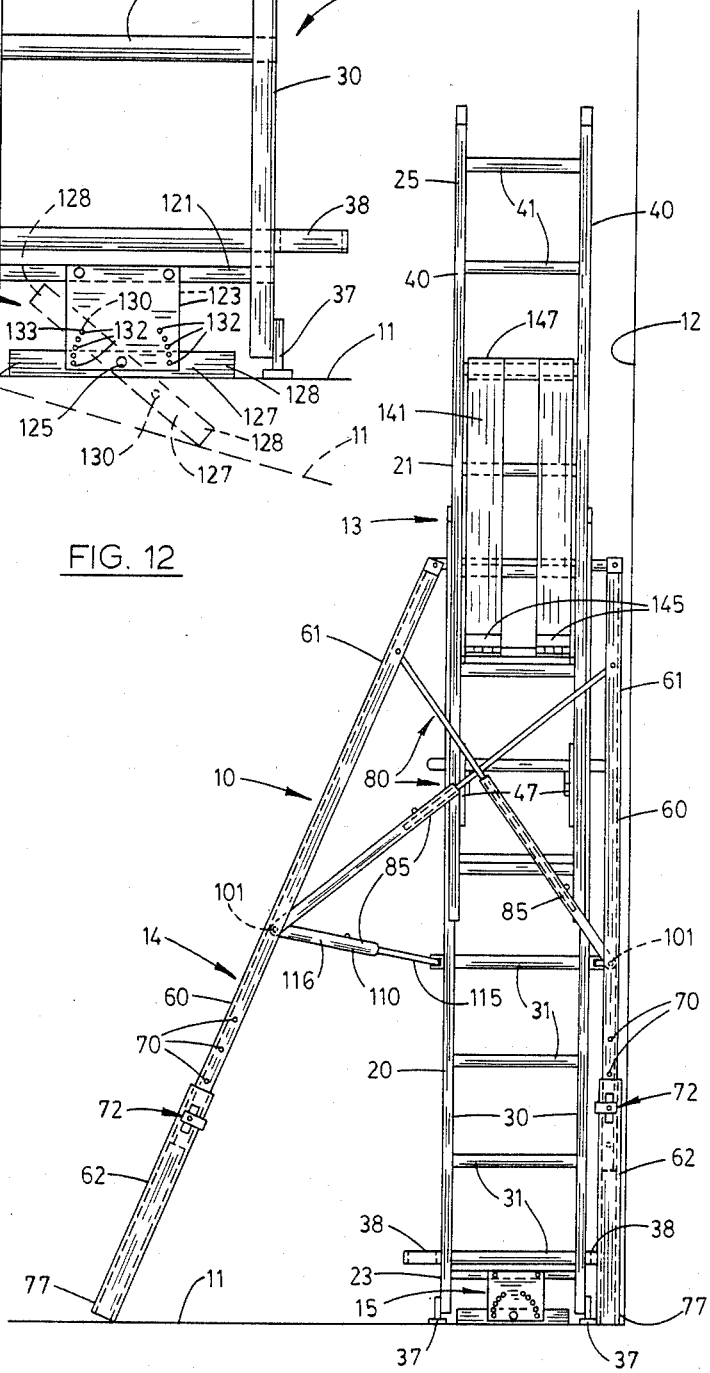
FIG. 2 is a front elevation of the ladder apparatus deployed in a second representative operative attitude on a flat supporting surface and immediately adjacent to a vertical surface.
Figure 3:
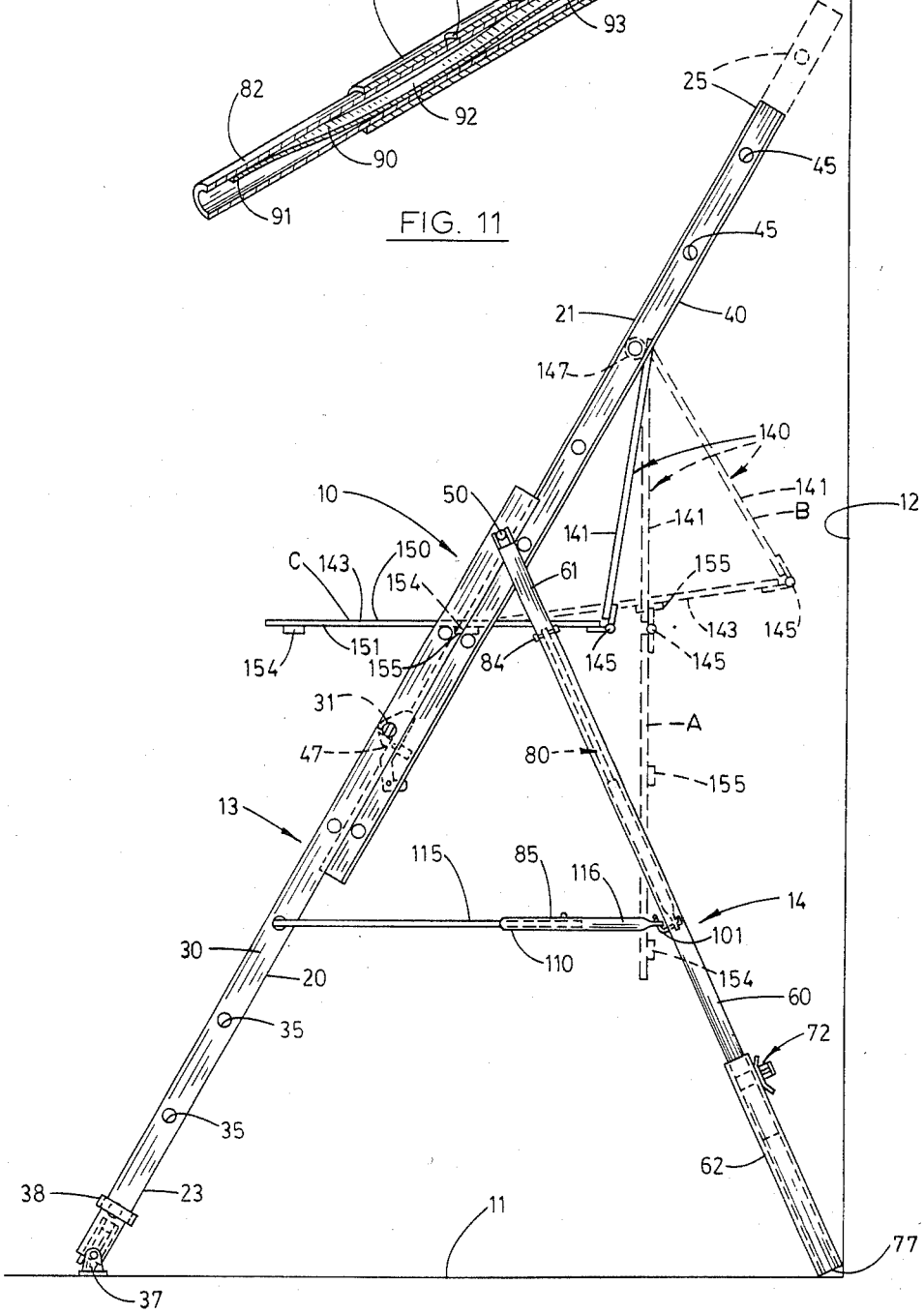
FIG. 3 is a side elevation of the ladder apparatus deployed in a third representative operative attitude on a flat supporting surface and facing a vertical surface and showing a collapsible platform thereof in full lines in a deployed position, in phantom lines in a position preliminary to deployment and in phantom lines in a collapsed position.

Referring more particularly to the drawings, the ladder apparatus of the present invention is generally indicated by the numeral 10 in FIGS. 1, 2 and 3. As shown in those views, the ladder apparatus is displayed in several typical operative attitudes and is rested in upstanding relation on a ground or supporting surface 11. For purposes of illustrating the operation and utility of the ladder apparatus of the present invention, the ladder apparatus is shown in FIGS. 2 and 3 deployed adjacent to a vertical surface 12.

The ladder apparatus 10 has a ladder assembly 13, a support assembly 14 and a base leveling assembly 15.

The ladder assembly 13 has a predetermined lower section or portion 20 and an upper, or extension, section or portion 21. The lower portion has a base 23 adapted to be disposed in rested relation on a supporting surface 11 when the ladder apparatus is deployed in an operative attitude, such as shown in FIGS. 1, 2 and 3. The extension portion of the ladder assembly has a top portion 25 which, as will hereinafter be described, is adapted to be extended to an elevated work area when the ladder apparatus is operatively deployed.

The lower portion 20 of the ladder assembly 13 has a pair of elongated, substantially straight rails or rail members 30 spaced in substantially parallel relation a predetermined width in a substantially common plane and interconnected by a plurality of spaced rungs 31 substantially right angularly related to the rails. Each of the rungs has a bore 33 extending axially therethrough and communicating externally of the rails through apertures 35 in the rails 30. Each rail mounts a foot member 37 at the base 23 thereof adapted to be rested upon a supporting surface 11 in an operative attitude. The feet are individually pivotable about a substantially common axis substantially right angularly related to the rails, as can best be seen in FIG. 3, and preferably have roughened or abrasive surfaces disposed for engagement with the supporting surface.

Figure 9:
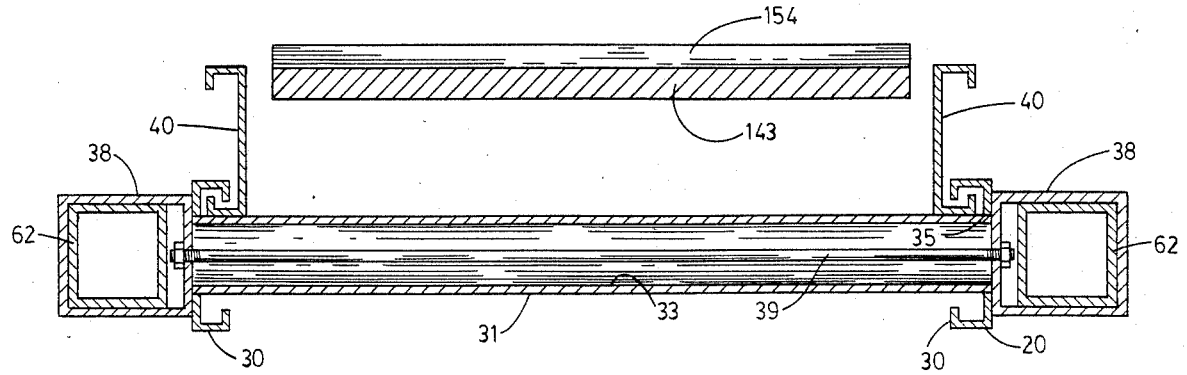
FIG. 9 is a somewhat enlarged transverse horizontal section taken on line 9—9 in FIG. 4.
Figure 13:
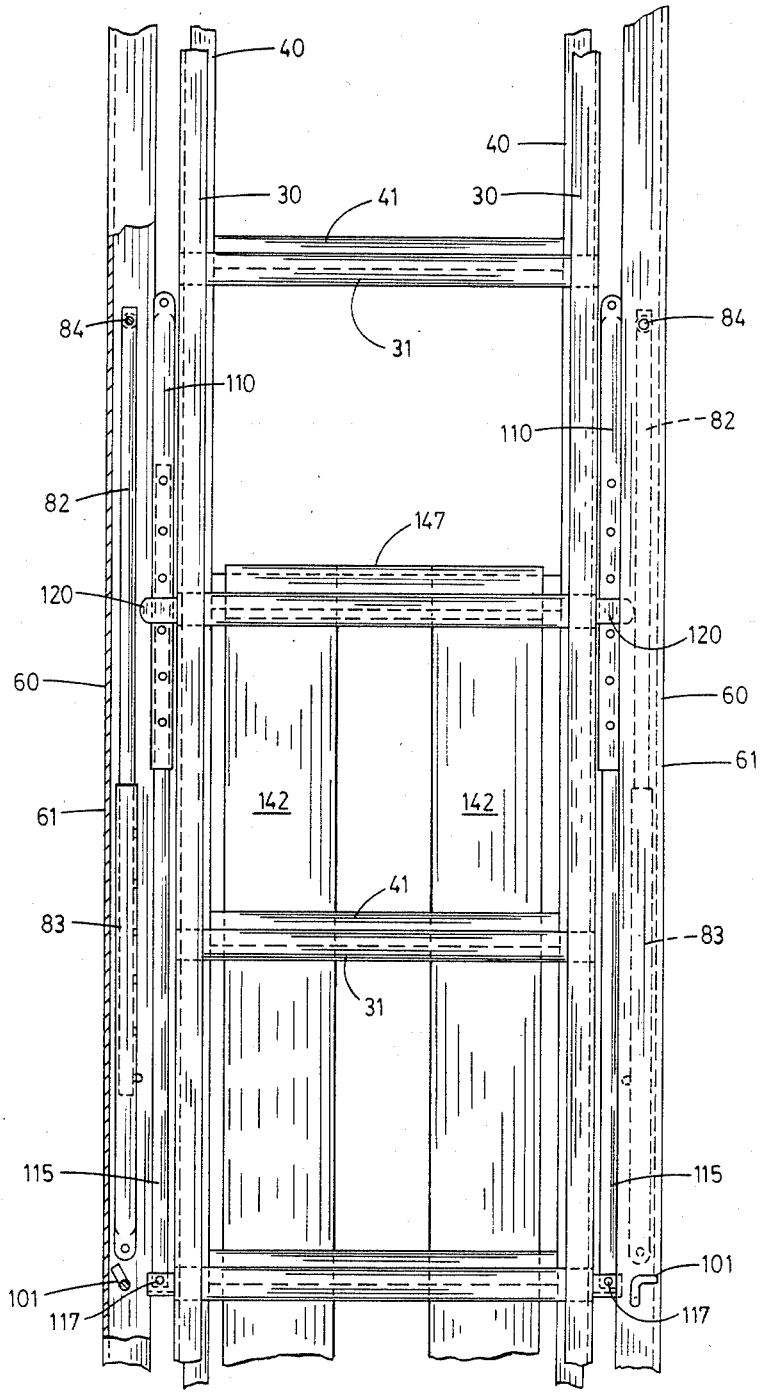
FIG. 13 is a somewhat further enlarged fragmentary front elevation of the central portion of the ladder apparatus deployed in a collapsed attitude.

As can best be seen in FIGS. 1 and 9, square section retention sleeves 38 are individually mounted on the rails by a mounting bolt and nut assembly 39 extending through the bore 33 of a rung 31 of the lower portion 20.

The extension portion 21 of the ladder assembly 13 has a pair of rails or rail members 40 spaced from each other in substantially parallel relation in a substantially common plane and interconnected by a plurality of rungs 41 of substantially the same construction to those of the lower portion 20, each having a bore 43 extending axially therethrough and externally communicating through apertures 45 in the rails.

As can best be seen in FIGS. 6, 7, 8 and 9, the rails 30 and 40 are of substantially convexly lipped channel construction and are disposed in slidable interconnecting relation to permit telescopic movement of the extension portion 21 axially along the lower portion 20 to dispose the top portion 25 a selected distance from the lower portion 20, substantially in the manner of a conventional extension ladder. Conventional locking assemblies 47 are individually mounted on one of the rungs 31 of the lower portion 20 releasably to retain the extension portion in a selected attitude of extension in accordance with conventional extension ladder construction.

Figure 4:
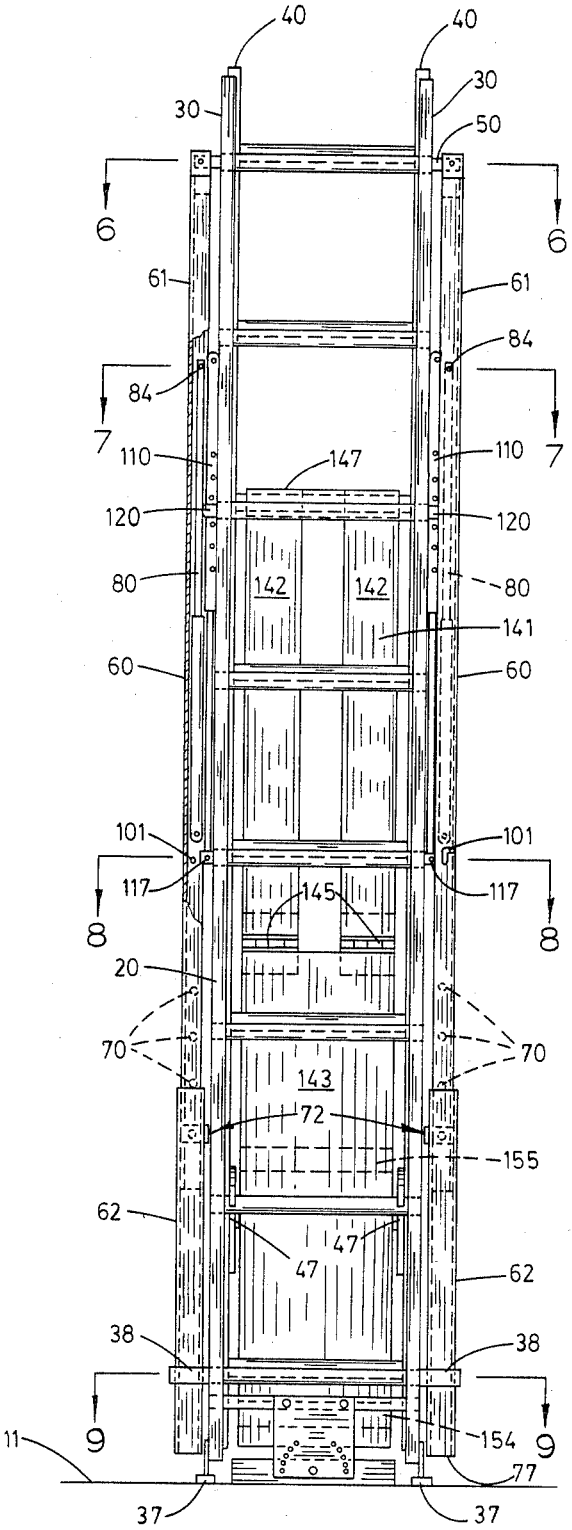
FIG. 4 is a front elevation of the ladder apparatus disposed in a collapsed attitude.
Figure 6:
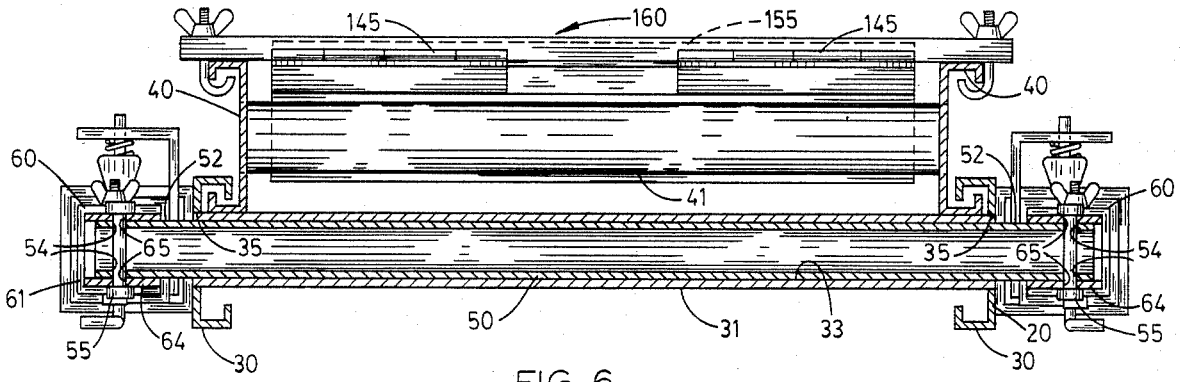
FIG. 6 is a somewhat enlarged transverse horizontal section taken on line 6—6 in FIG. 4.

The support assembly 13 of the ladder apparatus 10 includes an axle or mounting rod 50 inserted through a bore 33 of the uppermost rung 31 on the lower portion 20, as viewed in FIGS. 4 and 6. The mounting rod has a diameter less than the interior diameter of the bore 33 to permit substantially unimpeded rotation thereof about an axis of rotation constituting a final axis or line of reference substantially transverse to the longitudinal axis of the ladder assembly 13. The mounting rod has opposite end portions 52, each having a pivot bore 54 extending diametrically therethrough and dimensioned to receive a pivot pin 55 therein.

The support assembly 14 further includes a pair of elongated leg members 60 of substantially identical construction and dimensions. Each leg member has an upper or channel portion 61 and a lower, or extension portion 62. The upper portion 61 has a substantially rectangular configuration in cross section, as can best be seen in FIGS. 6, 7, 8 and 9, to define a channel 63 therein. The upper portion 61 of each leg member 60 has a flanged mounting end 64 with mounting apertures 65 aligned on opposite sides thereof. The apertures are aligned with pivot bores 54 and the pivot pin 55 is inserted therethrough to mount the leg member 60 and to define an axis of rotation substantially right angularly related to the axis of rotation of the mounting rod 50.

The points of such mounting of the leg members constitute first points.

The lower portion 62 of each leg member 60 is square section tubing which is dimensioned to be received about the upper portion thereof in close-fitting, slidably extendable relation thereto. A plurality of bores 70 extend through the upper portion 61 of each leg member in predetermined spaced relation to each other. A transversely aligned bore 71 extends through the lower portion 62 of each leg member in a predetermined position capable of registry with a selected one of the bores 70 upon selected slidable movement of the lower portion 62 along the upper portion 61. As can best be seen in FIGS. 2, 5 and 8, a locking pin assembly 72 is mounted on the lower portion 62 of each leg member immediately adjacent to the bore 71. The locking pin assembly includes an angle bracket 73 mounted on the lower portion 62 having a locking pin 74 mounted therein for endward insertion through the bore 71 and into a selected one of the bores 70. An ear piece 75 is affixed to the pin and a compression spring 76 is captured about the locking pin between the bracket 73 and the ear piece so as to resiliently urge the pin into the bores 71 and 70. Thus, it will be seen that retraction of the ear piece in the direction of the bracket and against the compression spring permits retraction of the locking pin from the bore 70 permitting the lower portion 62 to be endwardly repositioned on the upper portion 61 of each leg member. Thus, the effective operable lengths of the leg members can be adjusted. The locking pin assembly is then employed to again secure the lower portion relative to the upper portion by inserting the locking pin in another bore 70. The lower portion 62 of each leg member has a distal end 77 adapted for ground engagement.

Figure 5:
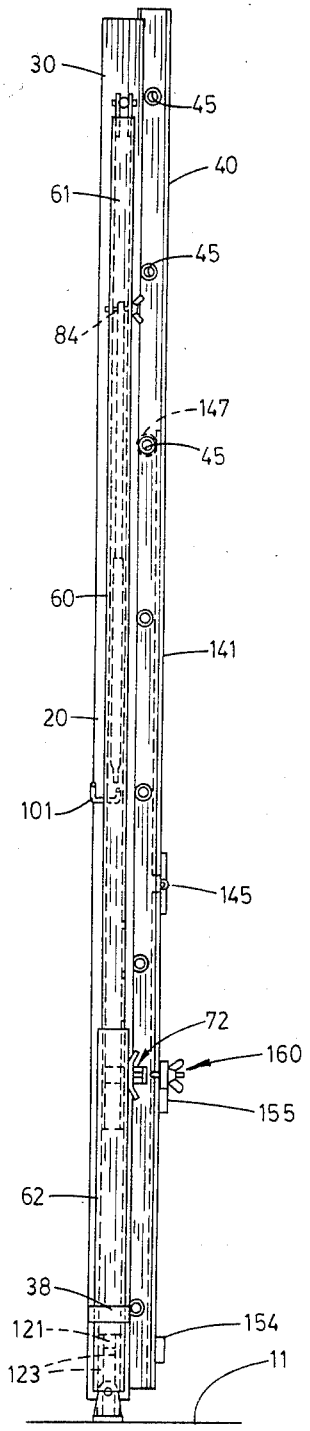
FIG. 5 is a side elevation of the ladder apparatus disposed as shown in FIG. 4.

As can be seen in FIG. 4, the leg members 60 are adapted to be disposed, in a collapsed attitude, in substantially parallel relation to the rails 30 of the ladder assembly 13. In such an attitude, the channel 63 of the upper portion 61 is disposed in facing relation to a rail 30. In order to retain the leg members in this collapsed attitude the lower portions 62 are released, using the locking pin assemblies 72 and moved upwardly along the lower portions until the distal ends 77 are above the retention sleeves 38. The lower portions are then individually slidably moved within their individual retention sleeves, as shown in FIGS. 4 and 5, and the locking pin assemblies employed again to secure the lower portions relative to the upper portions, preferably so that the distal ends thereof are above their respective foot members 37. The lower portions 62 are thus captured in position against their respective rails as shown in FIG. 9.

The support assembly 14 further provides a first pair of adjustable braces or brace assemblies 80 of substantially identical dimensions and construction. Each brace of the pair of braces has a tubular first or mounted portion 82 and a tubular second or telescoping portion 83 slidably received about the first portion for slidable movement axially thereof. The first portion of each brace is mounted by a suitable pivot pin assembly 84 on the upper portion 61 of each leg member 60 within the channel 63 thereof for pivotal movement about a pivot axis substantially transverse to the longitudinal axis of such leg member. As can best be seen in FIG. 7, the first portions 82 and thus the braces are offset relative to each other within their respective channels 63 on their respective pivot pin assemblies to permit unobstructed crossing thereof, in the manner shown in FIG. 1.

Figure 11:
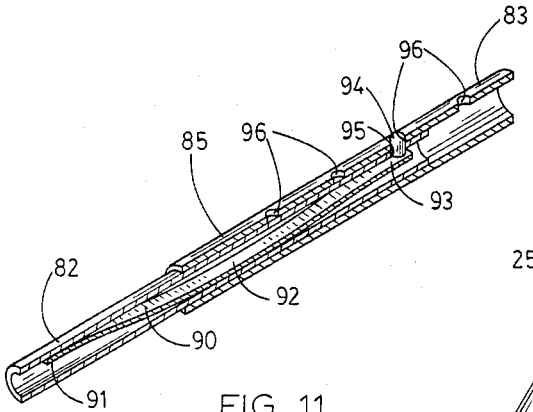
FIG. 11 is a somewhat enlarged, fragmentary perspective view taken in longitudinal section from a position generally indicated by line 11—11 in FIG. 1.

The second portion 83 of each brace is adapted to be deployed in a variety of attitudes of extension relative to the first portion to accommodate the particular position in which its respective leg member is placed. Each second portion is retained in a selected attitude of extension by means of a retaining assembly 85, as can best be seen in FIG. 11. As shown therein, the first portion 82 has a leaf spring 90 mounted therewithin having a fastened end 91 secured farthest within the first portion, a flexing central portion 92 contacting the internal surface of the first portion and a remote end 93 having a pin 94 extending through an aperture 95 in the first portion. The remote end is not fastened to the first portion except by extension of the pin through the aperture. However, the flexing central portion of the leaf spring retains the remote portion in engagement with the interior surface of the first portion of the brace and the pin fully extended through the aperture.

The second portion 83 of each brace has a plurality of apertures 96 spaced from each other longitudinally of the second portion and each dimensioned to receive the pin 94 therethrough. It will be seen that by pressing the pin 94 downwardly and from the aperture 96 of the second portion, slidable telescoping movement of the first and second portions of each brace can be achieved. Thus, each brace can individually be lengthened or shortened and retained in the desired length by releasing the pin to extend through a selected aperture 96 of the second portion.

The second portion 83 of each brace 80 has a flattened distal end portion 98 having an aperture 99 therethrough, as can best be seen in FIG. 10. The upper portion 61 of each leg member mounts a retaining member 101 having a first hook 102 extending within the channel 63 thereof and a second hook 103 extending outwardly laterally of the leg member. As can best be seen in FIG. 10, the first hook is preferably in the form of a right angle bend while the second hook preferably is so formed as to provide a right angle bend with a second right angle bend out of the plane of the first bend thereof. The retaining member 101 of each leg member is mounted on its respective leg member substantially midway down the leg member as can be seen in FIGS. 1 and 3. The aperture 99 of each brace 80 is dimensioned so that the first hook can be extended therethrough as shown in FIG. 10. Thus, when both braces are adjusted as to length to accommodate the desired positions of the leg members, the retaining assemblies 85 operated to lock the first and second portions of each brace relative to each other and the braces connected to the first hooks of the retaining members of the leg members opposite to the ones on which those respective braces are mounted, the leg members are locked in the selected spaced relation to each other as can best be visualized in FIGS. 1 and 2. When the ladder apparatus 10 is in the collapsed attitude shown in FIGS. 4 and 5, the braces are, of course, disconnected from the first hooks 102 and are simply captured within their respective channels 63 between their respective leg members and the rails 30.

Figure 8:
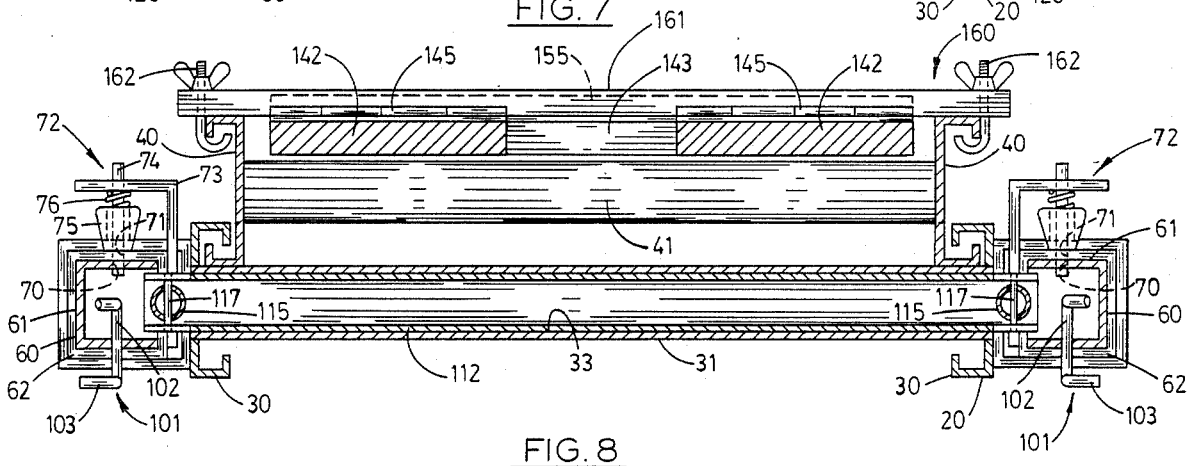
FIG. 8 is a somewhat enlarged transverse horizontal section taken on line 8—8 in FIG. 4.

The support assembly 14 has a second pair of braces or brace assemblies 110 secured on the lower portion 20 of the ladder assembly 13. As can best be seen in FIGS. 1 and 8, an axle or mounting rod 112 extends completely through a rung 31 of the lower portion 20 and is dimensioned to permit rotation of the mounting rod therein about its longitudinal axis constituting a second axis or line of reference. The mounting rod has opposite end portions 113 which extend outwardly through the apertures 35 of the rails 30. The end portions are, as shown in FIGS. 1 and 8, of a clevis type construction.

Each brace 110 of the second pair of braces is of construction substantially identical to the braces 80 of the first pair of braces. Each brace 110 has a tubular mounted or first portion 115 and a tubular telescoping or second portion 116 slidably thereabout for movement relative thereto telescopically thereabout. The first portion 115 of each brace is pivotally mounted on its respective end portion 113 of the mounting rod 112 by a pin 117 for pivotal motion thereof about an axis substantially right angularly related to the longitudinal axis of the mounting rod. The points of such mounting of the second pair of braces constitute second points. Each brace 110 has a retaining assembly 85 already described and having the same construction as that shown in FIG. 11 except, of course, that it is borne by and interconnects first and second portions 115 and 116 rather than first and second portions 82 and 83. The retaining assembly operates in the same manner as already described with respect to braces 80 to retain the braces 110 individually in their selected attitudes of extension. The second portion of each brace 110 has a flat distal end portion 118 providing an aperture 119 therein adapted to receive the second hook 103 of the retaining member 101 of the leg member borne by the railing 30 on the same side of the ladder assembly 13, as can best be visualized in FIGS. 1 and 10. A spring clip 120 is mounted on and extends from each end of the rung 31 in FIG. 7 and is adapted releasably to receive the brace 110 on its respective side of the ladder assembly 13 when pivoted upwardly and into snap-fitted engagement therewith, as best shown in FIGS. 4 and 7.

Figure 12:
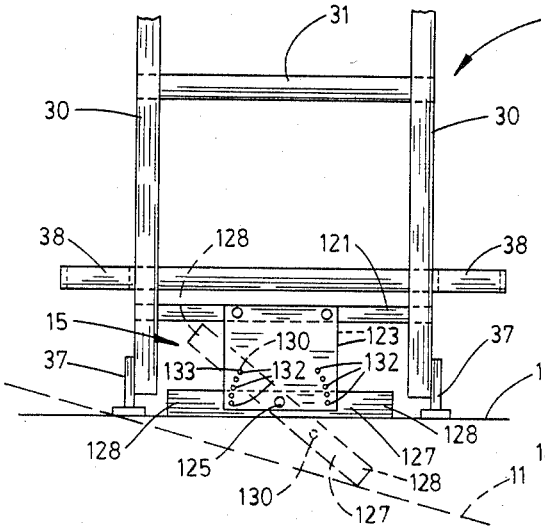
FIG. 12 is a somewhat enlarged fragmentary view of the lower portion of the ladder apparatus shown in full lines deployed on a horizontal supporting surface and in phantom lines on a sloping surface.

The base leveling assembly 15 of the ladder apparatus 10 is shown best in FIG. 12. The base leveling assembly includes a substantially straight channel member 121 fixedly secured on and interconnecting the rails 30 on the lower portion 20 of the ladder assembly 13 beneath the lowermost rung 31. A pair of substantially flat plates 123 are secured as by bolts, welding or the like, in substantially parallel spaced relation on the channel member extending downwardly therefrom. A bolt 125 is mounted on and rigidly interconnects the plates in spaced relation to the channel member. The bolt defines an axis substantially right angularly related to the plates 123 and a leveling bar 127, having opposite ends 128, is mounted on the bolt for rotational movement about its longitudinal axis. The leveling bar has a pair of apertures 130 spaced substantially equidistantly from and on opposite sides of the bolt 125. A plurality of corresponding holes 132 extends through the plates 123 spaced from the bolt a distance equal to that by which the apertures 130 of the leveling bar 127 are spaced from the bolt. The holes 132 are so positioned that either of the apertures 130 can selectively be aligned with corresponding holes 132 of the plates 123 to dispose the bar 125 in a selected angular attitude relative to the channel member 121. A retaining pin 133 is provided for insertion into and through the selected holes 132 and apertures 130 to retain the leveling bar in such a selected attitude.

The ladder apparatus in the preferred embodiment has a staging platform member 140 collapsibly deployed on the upper portion 21 of the ladder assembly 13, as can best be seen by reference to FIGS. 1 and 3. The platform has an upper portion 141, preferably constructed of two substantially parallel members 142 separated from each other to define a space therebetween to enhance visibility during use, and a dependent portion 143, preferably a solid panel, secured on the upper portion by and pivotable about a hinge assembly 145. The upper portion 141 is pivotally mounted on a rung 41 of the upper portion 21 of the ladder assembly by a mounting sleeve 147 affixed on the upper portion and mounted for rotational movement about the rung. The staging platform can be mounted on whichever rung is most appropriate. However, in the preferred embodiment the third rung 41 from the top is preferred. The width of the staging platform is such as to allow it to fit between the rails 40. The dependent portion 143 has a first or staging surface 150 and an opposite, subjacent surface 151. The subjacent surface mounts a first stop member 154 nearest the free, remote end of the platform and a second stop 155 nearest the hinge assembly 145. The first and second stop members are spaced from each other and individually adapted to engage a rung 41 or 31 when the staging platform 140 is disposed in an operative attitude, as will hereinafter be described.

Figure 7:
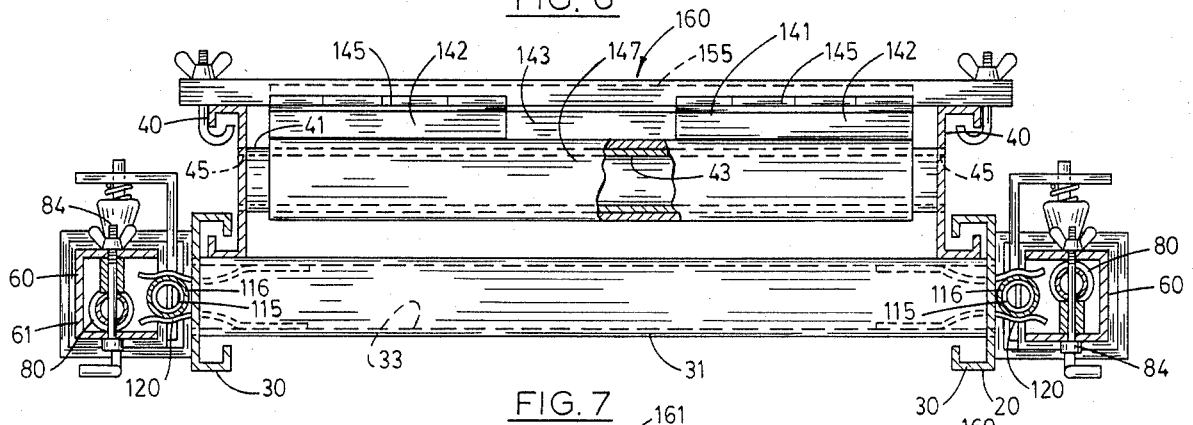
FIG. 7 is a somewhat enlarged transverse horizontal section taken on line 7—7 in FIG. 4.

As will also hereinafter be described, a platform securing assembly 160 shown best in FIGS. 6, 7 and 8 is employed to retain the staging platform 140 in a flattened or collapsed attitude. The platform securing assembly consists of a cross piece 161 having J-hook assemblies 162 extending substantially transversely through the opposite ends thereof. The platform securing assembly is releasably positionable in capturing relation to the staging platform in the collapsed attitude by loosening the J-hook assemblies so that they can be positioned over the return bent lips of their respective rails 40. The J-hook assemblies are then tightened down to bind the cross piece on the rails in capturing relation to the dependent portion 143 of the staging platform.

Second Embodiment

Portions of the present invention can be constructed separately from the ladder assembly 13 to provide an auxiliary support assembly adapted for attachment on a conventional extension ladder having tubular, open-ended rungs to afford such ladder improved stability and applicability in varied work environments virtually equivalent to that of the ladder apparatus of the present invention shown and described herein in the first preferred embodiment. The auxiliary support assembly, when installed on an existing ladder, appears as shown in the drawings hereof and previously described in connection with the first embodiment. Thus, in a second embodiment, the mounting rod 50 of the leg members 60; mounting rod 112 of the second pair of braces 110; and mounting bolt and nut assembly 39 of the retention sleeves 38, can be inserted through appropriate rungs to permit mounting of support assembly on the ladder.

Further, the base leveling assembly 15 can be secured on a rung to obtain auxiliary leveling of the base of the ladder assembly to which it is attached. Similarly, the staging platform 140 is provided with a sleeve mount 147 or the like which is adapted to be installed on a rung of an existing ladder to mount the staging platform 140 thereon as heretofore shown and described.

Thus, the present invention also provides an auxiliary support assembly of compact, demountable design for attachment on a conventional ladder operable in the manner of the ladder apparatus of the first preferred embodiment of the present invention.

OPERATION

The operation of the described embodiments of the subject invention is believed to be clearly apparent and is briefly summarized at this point. The ladder apparatus 10 is adapted operatively to be deployed in myriad work environments. Although the assembly is shown in the drawings deployed in several different attitudes, it will be apparent that such representations are illustrative and in no sense limiting. Further, it will be understood that the steps described below in reference to the operative deployment of the ladder apparatus may be varied in sequence to suit a particular work environment or the preferences of the user thereof.

In deploying the ladder apparatus 10 for use in a particular work environment, a suitable supporting surface 11 is first chosen, preferably spaced from surrounding structures to permit an angular inclination of the ladder assembly 13. If a suitable, substantially horizontal supporting surface is available, the foot members 37 are first deployed on such surface to define a first base area. The top portion 25 of the ladder assembly 13 is then raised to dispose it in an elevated attitude relative to the foot members.

The lower portions 62 of the leg members 60 are then released using the locking pin assemblies 72 and moved slidably upwardly along their respective upper portions 61 of the leg members and from the retention sleeves 38 to free the leg members for positioning in supporting relation to the ladder assembly.

Upon removal of the leg members 60 from the retention sleeves 38, the lengths of the leg members are individually adjusted to lengths required to support the ladder assembly 13 in the particular attitude desired. This is achieved by slidably positioning each lower portion 62 on its respective upper portion 61 until the overall length of that leg member is that desired. Each lower portion is then secured in the selected position using its respective locking pin assembly 72 on the upper portion. The leg members are then individually pivoted about the longitudinal axis of the mounting rod 50 and that of pivot pin 55 to position the leg members preliminarily in selected spaced relations from both the ladder assembly 13 and each other. The distal ends 77 are rested on the supporting surface 11, and the ladder apparatus 10 is thereby deployed in a self-supporting, but non-stablized attitude, with the distal ends 77 defining a second base area remote from the first base area.

Each brace of the first pair of braces 80 is then pivoted away from the leg member 60 on which it is mounted and the telescoping second portion 83 thereof is extended a distance sufficient to dispose the distal end portion 98 thereof in proximity to the retaining member 101 of the opposite leg member 60. Retaining assembly 85 is operated by depressing pin 94 and sliding the telescoping portion 83 until an appropriate aperture 96 is aligned above the pin and leaf spring 90 urges the pin therethrough. First hook 102 is then inserted, by maneuvering the brace 80, through the aperture 99 of each brace to retain each brace in engagement with the leg member 60, as shown best in FIGS. 1 and 10. Upon attachment of the first pair of braces to the leg members as described, the leg members are rigidly retained in a selected attitude of spaced separation from each other. It will be seen, however, that the leg members are at this point, if raised from engagement with the supporting surface, pivotal relative to the ladder assembly 13.

Each brace of the second pair of braces 110 is then pivoted to dispose the distal end portion 118 of the telescoping second portion 116 thereof in proximity to the retaining member 101 of the leg member 60 extending from the same rail 30 of the ladder assembly 13 as that particular brace 110. Using its respective retaining assembly 85 as heretofore described, the second portion 116 is then extended to dispose aperture 119 of distal end portion 118 thereof in alignment with the second hook 103 of the retaining member 101. Retaining assembly 85 is then employed to lock the second portion in the selected attitude of extension and the second hook 103 is passed by maneuvering the brace, through aperture 119 to secure the distal end portion of the brace in engagement with the leg member 60. The leg members are thus rigidly retained in spaced relation a selected distance from the base 23 of the ladder assembly 13. The bracing provided by the first pair of braces 80 and second pair of braces 110 serves effectively to prevent both inadvertent convergence and divergence of the leg members 60 as well as restraining the ladder assembly 13 against twisting about its longitudinal axis.

In the event that a substantially horizontal surface area is not conveniently accessible for support of the foot members 37, the support assembly 14 can be employed to support the ladder assembly 13 in an attitude such that the longitudinal axis thereof is oriented in a substantially vertical plane. As shown in FIG. 12, a sloping support surface is illustrated in phantom lines at 11. In order to use the support assembly 14, the ladder assembly 13 is first positioned upon one foot member 37 which is to rest upon a relative high point of that area of the support surface in which it is desired to position the base 23 of the ladder assembly. The end 128 of the leveling bar 127 remote from the foot member 37 resting upon the supporting surface is pivoted downward to engage the sloping surface while the ladder assembly is held in a substantially vertical attitude. Aperture 130 of the leveling bar 127 nearest the foot member on the left as viewed in FIG. 12 is aligned with appropriate corresponding holes 132 of the plates 123 and pin 133 is inserted therethrough to retain the bar 127 in the attitude selected. Thus, as illustrated in phantom lines in FIG. 12, the end 128 on the right in phantom lines as viewed therein and the foot member 37 on the left as viewed therein support the ladder assembly in upstanding relation even on the sloping supporting surface 11 shown in phantom lines in FIG. 12.

As can best be seen in FIG. 3, the staging platform 140 hangs gravitationally in a substantially vertical attitude from the rung 41 on which it is mounted when the ladder apparatus 10 is collapsed as shown in FIGS. 4 and 5. Consequently, when the ladder apparatus is operatively deployed as described above and as is shown in phantom lines and designated by the letter "A" in FIG. 3, the ladder apparatus continues to hang gravitationally from its rung. To use the staging platform, the dependent portion 143 is grasped and caused to pivot about hinge assembly 145 to dispose the platform in the attitude indicated in phantom lines in FIG. 3 and labeled "B" therein constituting a "ready position". The first stop member 154, on left as viewed in FIG. 3, in the "B" position is disposed in abutted engagement with a rung 41 of the upper portion 21 of the ladder assembly or a rung 31 of the lower portion 20. This procedure can be performed prior to mounting of the ladder assembly 13 by the user thereof or while the user is perched on the lower portion 20 of the ladder assembly. Once the staging platform is disposed in attitude of disposition "B", the user can proceed upward along the ladder assembly to a rung immediately above that engaged by the first stop member 154. The dependent portion 143 is then easily contacted by the user's foot or hand to lift the end thereof from engagement with the rung and first stop member 154 above the rung and thus to free the staging platform for gravitational sliding movement into the attitude of disposition "C", illustrated in full lines in FIG. 3 constituting a "work position". In attitude "C", second stop member 155, on the right as viewed in FIG. 3, engages the same rung to hold the staging platform against further movement in the same direction. The staging platform then can be used to support equipment and/or the user as the work operation requires.

The ladder apparatus 10 is disposed in a collapsed attitude for transport and storage by a reversal of the above procedures. The dependent portion 143 of the staging platform 140 is moved back to and beyond attitude of disposition "B" and allowed to return by gravity to the flattened attitude of disposition "A". The upper portion 21 of the ladder assembly 13 is lowered to the position shown in FIGS. 4 and 5 using the locking assemblies 47. The first pair of braces 80 and second pair of braces 110 are disengaged from the first and second hooks 102 and 103, respectively, of the leg members 60. Telescoping second portions 83 and 116, respectively, are retracted along their respective first portions 82 and 115 using their respective retaining assemblies 85, as already described. The first pair of braces 80 are then pivoted downwardly and into the channels 63 of their respective leg members. Conversely, the braces 110 are individually pivoted upwardly and snap-fitted into their respective spring clips 120, as shown in FIGS. 4 and 7, to retain them in juxtaposition to their respective rails 30.

The lower portion 62 of each leg member 60 is retracted along the upper portion 61 thereof and the leg members pivoted into parallel juxtaposition with the rails 30. In such an attitude, the channel 63 of the upper portion 61 of each leg member is disposed in partial capturing relation to the first brace 80 and second brace 110 on its side of the ladder assembly 13, as can best be seen in FIG. 7. The lower portions 62 are individually slidably inserted in their respective retention sleeves 38 and the locking pin assemblies 72 employed to secure each lower portion relative to its upper portion. Staging platform 140 is then disposed substantially flatly along the rungs 41 of the upper portion 21 and retained thereagainst by installation of the platform securing assembly 160.

As shown in FIG. 2, the ladder apparatus 10 can be employed in work environments in which an obstacle such as vertical surface 12 prevents the deployment of a leg member 60. As can readily be seen, the ladder apparatus can nonetheless be erected in such a way as to provide stability for the ladder assembly 13 and without even contacting the vertical surface. The ladder apparatus can be disposed in this and other configurations by adjusting and positioning the leg members to rest upon available supporting surfaces 11 in the desired arrangement and then interconnecting the ladder assembly 13 and leg members using the braces 80 and 110, as heretofore described.

Thus, it is seen that the ladder apparatus 10 of the present invention possesses a stability and an adaptability not heretofore achieved in the art. Leg members 60 thereof are pivotable and extendable to enable deployment in a virtually infinite number of attitudes and relationships for optimum elevational support of the ladder assembly 13 in a multitude of environments where ladders could not previously be employed. Further, the first pair of braces 80 is adapted rigidly to interconnect the leg members to retain the members in fixed spaced relation separate from each other and to prevent twisting of the ladder assembly 13 about its longitudinal axis. The first pair of braces further provides auxiliary reinforcement of the intermediate sections of the leg members whereby the possibility of buckling of the leg members upon full extension thereof is virtually eliminated.

The second pair of braces 110 provides adjustable support for retaining the leg members 60 in selected attitudes of spaced relation relative to the ladder assembly 13. Thus, the base 23 is restrained against slippage away from the distal ends 77 of the leg members, and the entire ladder apparatus, in an operative attitude of deployment, is further strengthened.

It is further seen that the ladder apparatus 10 of the present invention is adapted for rapid, unassisted deployment and, similarly, facilitates disposition in a collapsed attitude which occupies little more space than a conventional extension ladder.

Although the invention has been herein shown and described in what are conceived to be the most practical and preferred embodiments, it is recognized that departures may be made therefrom within the scope of the invention, which is not to be limited to the illustrative details disclosed.

Having described my invention, what I did claim as new and desire to secure by Letters Patent is:

1. A support apparatus for retaining a ladder in a stable upright attitude and being selectively adjustable to conform to the environment in which the ladder is to be supported, the support apparatus comprising a pair of leg members pivotally mounted on the ladder at spaced first points defining a first line reference substantially right-angularly related to the ladder, each leg member of said pair having a lower portion linearly adjustable to define a selected length for the leg member; a first pair of brace assemblies individually mounted on the leg members at predetermined pivot substantially equal distances from the first points of their respective leg members for substantially pivotal movement, each brace assembly of said first pair composed of components linearly adjustable relative to each other to define a selected length for the brace assembly and means borne by a distal end thereof for releasable attachment on the other of said leg members at a predetermined attachment point spaced from said first point of that leg member; and a second pair of brace assemblies individually mounted on the ladder at second points defining a second line of reference substantially parallel to the first line of reference and spaced therefrom for substantially pivotal movement, each brace assembly of said second pair composed of components linearly adjustable relative to each other to define a selected length for the brace assembly and means borne by a distal end thereof for individual releasable attachment on one of the leg members whereby the leg members are adapted for independent positioning in selected positions in conforming relation to said environment and in supporting relation to the ladder and the brace assemblies of said first and second pairs of brace assemblies are independently adjustable for said releasable attachment on the leg members to brace said leg members in the positions selected.

2. The support apparatus of claim 1 wherein the leg members are mounted on the ladder for pivotal movement substantially about said first line of reference and for said pivotal movement about individual axis substantially right-angularly related to the first line of reference.

3. The support apparatus of claim 2 wherein the leg members are interconnected by a common shaft substantially coaxial with said first line of reference for said pivotal movement of the leg members substantially about said first line of reference.

4. A support apparatus for retaining a ladder in a stable upright attitude and being selectively adjustable to conform to the environment in which the ladder is to be supported, the support apparatus comprising a pair of leg members, each leg member of the pair adapted to be individually pivotally mounted on the ladder at a first point and having a lower portion linearly adjustable to define a selected length for the leg member; a first pair of brace assemblies, each brace assembly of the pair adapted to be individually mounted on and to interconnect the leg members and composed of components linearly adjustable relative to each other to define a selected length for the brace assembly; and a second pair of brace assemblies, each brace assembly of the pair adapted to be individually mounted on and to interconnect the ladder and one of said leg members and composed of components linearly adjustable relative to each other to define a selected length for the brace assembly whereby the leg members are adapted for independent positioning in selected positions in conforming relation to said environment and in supporting relation to the ladder and the brace assemblies of said first and second pairs of brace assemblies are independently adjustable to brace said leg members in the positions selected.

5. The support apparatus of claim 4 wherein said components of each of the brace assemblies of the first and second pair are telescopically interconnected and have lock assemblies including a plurality of holes disposed in spaced relation aligned longitudinally of one of said components and a spring borne pin mounted on the other of the components and selectively engageable in one of said holes releasably to interlock the components so as to define a rigid brace assembly of selected length.

6. The support apparatus of claim 5 wherein each of the brace assemblies of said first and second pairs has an end portion having an aperture therein and a retaining member is individually mounted on each leg member and has a pair of hooks each adapted to be extended through the aperture of one of said brace assemblies whereby said end portion of each brace assembly is releasably attachable to one of the leg members and each of said hooks and the lock assembly of its respective brace assembly are so related that the pin of the lock assembly can be released from engagement with said holes and the components longitudinally telescopically adjusted relative to each other to allow maneuvering of the aperture about its respective hook and upon reaching the fully attached position is so positioned that the pin of the lock assembly is disposed in alignment with the holes of the lock assembly for spring biased insertion of the pin through one of the holes rigidly to fix the length of said brace assembly required for the position of the leg member relative to the ladder.

7. The support apparatus of claim 4 in which the ladder has a pair of substantially parallel rail members interconnected by a plurality of rungs substantially right-angularly related to the rail members and at least two rungs of which are tubular, and wherein the support apparatus includes a pair of mounting rods adapted to be individually extended through said tubular rungs pivotally to mount the leg members of the support apparatus at said first points outwardly of the rail members and the brace assemblies of said second pair of brace assemblies at said second points outwardly of the rail members.

8. The support apparatus of claim 4 in which the ladder has a pair of substantially parallel rail members interconnected by a plurality of rungs substantially right-angularly related to the rail members and wherein the support apparatus has a work platform including a first panel pivotally mounted on one of said rungs, a second panel mounted on the first panel for pivotal movement relative thereto along a pivot axis substantially parallel to the rung on which the work platform is mounted, said second panel having a width permitting it to be inserted between the rail members of the ladder and rested on another of said rungs, and a pair of stops mounted on a surface of the second panel in predetermined positions whereby the second panel is positionable in a ready position, rested on a supporting rung on which it is desired to use the work platform and releasably retained in said ready position by a first of said stops engaging the supporting rung leaving the rungs of the ladder substantially clear for passage, and a work position, wherein said pivot axis is substantially directly below the rung on which the platform is mounted and the second panel extends between the rail members outwardly over the supporting rung and is substantially centered thereon and releasably retained in said work position by the second of said stops engaging the supporting rung.

9. A ladder apparatus adapted to be supported in a stable upright attitude and being selectively adjustable to conform to the environment in which it is to be supported, the ladder apparatus comprising a ladder assembly; a pair of leg members, the leg members of said pair individually mounted on the ladder assembly at spaced first points pivotal about a first axis substantially normal to the ladder assembly and being individually pivotal about second axes substantially normal to the first axis, each leg member of said pair having a lower portion linearly adjustable to define a selected length for the leg member; a first pair of brace assemblies, the brace assemblies of said first pair individually mounted on the leg members at predetermined pivot points substantially equal distances from the first points of their respective leg members for substantially pivotal movement about said pivot points, each brace assembly of said first pair composed of components linearly adjustable relative to each other to define a selected length for the brace assembly and means borne by a distal end thereof for releasable attachment on the other of said leg members at a predetermined attachment point spaced from said first point of that leg member; and a second pair of brace assemblies, the brace assemblies of said second pair individually mounted on the ladder assembly at second points aligned along a line of reference substantially parallel to said first axis for substantially pivotal movement, each brace assembly of said second pair composed of components linearly adjustable relative to each other to define a selected length for the brace assembly and means borne by a distal end thereof for individual releasable attachment on one of the leg members whereby the leg members are adapted for independent positioning in selected positions in conforming relation to said environment and in supporting relation to the ladder and the brace assemblies of said first and second pairs of brace assemblies are independently adjustable for said releasable attachment on the leg members to brace said leg members in the positions selected.

10. A ladder apparatus comprising:

A. a ladder assembly having 1. a pair of substantially parallel rail members,
2. a plurality of rungs substantially right-angularly related to and interconnecting the rail members; and B. a work platform having 1. a first panel pivotally mounted on one of said rungs of the ladder assembly,
2. a second panel mounted on the first panel for pivotal movement relative thereto along a pivot axis substantially parallel to the rung on which the work platform is mounted, said second panel having a width permitting it to be inserted between the rail members of the ladder assembly and rested on another of said rungs of the ladder assembly, and
3. a pair of stops mounted on a surface of the second panel, the stops of said pair mounted in predetermined positions permitting the second panel to be disposed in a ready position, rested on a supporting rung on which it is desired to use the work platform and releasably retained in said ready position by a first of said stops engaging the supporting rung leaving the rungs of the ladder substantially clear for passage, and a work position, wherein said pivot axis is substantially directly below the rung on which the platform is mounted and the second panel extends between the rail members outwardly over the supporting rung and is substantially centered thereon and releasably retained in said work position by the second of said stops engaging the supporting rung.

* * * * *

UNITED STATES PATENT AND TRADEMARK OFFICE

CERTIFICATE OF CORRECTION

PATENT NO. : 4,565,262

DATED : January 21, 1986

INVENTOR(S) : Donald E. Hawkins

It is certified that error appears in the above-identified patent and that said Letters Patent is hereby corrected as shown below:

Column 4, line 49, delete "final" and substitute ---first---.

Column 12, line 43, between "pivot" and "substantially" insert ---points---.

Signed and Sealed this

*Fifteenth* Day of *April 1986*

[SEAL]

*Attest:*

DONALD J. QUIGG

*Attesting Officer*

*Commissioner of Patents and Trademarks*